US009103240B2

(12) United States Patent
Heinemann

(10) Patent No.: US 9,103,240 B2
(45) Date of Patent: Aug. 11, 2015

(54) CAMSHAFT ADJUSTER

(75) Inventor: Robert Heinemann, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/005,894

(22) PCT Filed: Feb. 23, 2012

(86) PCT No.: PCT/EP2012/053100

§ 371 (c)(1),
(2), (4) Date: Sep. 18, 2013

(87) PCT Pub. No.: WO2012/143155

PCT Pub. Date: Oct. 26, 2012

(65) Prior Publication Data

US 2014/0007831 A1 Jan. 9, 2014

(30) Foreign Application Priority Data

Apr. 21, 2011 (DE) ..... 10 2011 007 883

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/3443* (2013.01); *F01L 2001/34479* (2013.01); *F01L 2001/34493* (2013.01)

(58) Field of Classification Search
CPC ..... F01L 1/344; F01L 1/3442; F01L 2001/34479; F01L 2001/34493
USPC ..... 123/90.15, 90.17; 464/160
See application file for complete search history.

(56) References Cited

U.S. PATENT DOCUMENTS

| | | | | |
|---|---|---|---|---|
| 5,924,395 | A * | 7/1999 | Moriya et al. | 123/90.15 |
| 6,546,842 | B2 * | 4/2003 | Raikamo | 92/121 |
| 6,725,817 | B2 * | 4/2004 | Methley et al. | 123/90.17 |
| 7,270,096 | B2 * | 9/2007 | Lancefield et al. | 123/90.17 |
| 8,051,818 | B2 * | 11/2011 | Myers et al. | 123/90.17 |
| 2005/0226736 | A1 | 10/2005 | Lancefield et al. | |
| 2010/0093453 | A1 | 4/2010 | Myers et al. | |

FOREIGN PATENT DOCUMENTS

| | | |
|---|---|---|
| DE | 10 2009 041755 | 4/2010 |
| EP | 0 799 976 | 10/1997 |
| EP | 0 806 550 | 11/1997 |
| EP | 0 859 130 | 8/1998 |
| GB | 2 369 175 | 5/2002 |
| GB | 2 432 645 | 5/2007 |
| WO | WO 01/12996 | 2/2001 |

* cited by examiner

*Primary Examiner* — Ching Chang
(74) *Attorney, Agent, or Firm* — Davidson, Davidson & Kappel, LLC

(57) ABSTRACT

A configuration of a camshaft phaser (1), which has a drive element (2), and at least two output elements (3, 4), the drive element (2) and the output elements (3, 4) having a plurality of radially oriented vanes (6) which overlap the lateral surfaces (9) of the adjacent element in the axial direction (7).

3 Claims, 2 Drawing Sheets

CAMSHAFT ADJUSTER

The present invention relates to a camshaft phaser.

BACKGROUND

Camshaft phasers are used in combustion engines to vary the valve timing of the combustion chamber valves. Consumption and emissions are reduced by adapting the valve timing to the actual load. One common type is the vane-type adjuster. Vane-type adjusters have a stator, a rotor and a drive sprocket. For the most part, the rotor is connected to the camshaft for conjoint rotation therewith. The stator and the drive sprocket are likewise interconnected, the rotor being disposed coaxially to and within the stator. The rotor and the stator have radial vanes that form oil chambers (vane cells) that act in mutual opposition and can be pressurized by oil and allow a relative movement between the stator and rotor. In addition, the vane-type adjusters have various sealing covers. A plurality of screw connections ensure a secure interconnection of the stator, drive sprocket and sealing cover.

U.S. Patent Application 2009/0173297 A1 describes a hydraulically actuable camshaft phaser that has a drive sprocket and, coaxially thereto, a stator having two rotors disposed concentrically relative to the stator. The stator can be made in one piece or be composed of a plurality of components. The rotors and the stator have radially oriented vanes. Thus, the stator and the rotors form working chambers that can be supplied with a hydraulic pressure medium, producing a relative rotation about the axis of rotation of the camshaft phaser between the rotor and the stator in question. A partitioning wall, which, as a component of the stator, is disposed between the rotors, axially separates the rotors from one another. Each rotor can be attached to a camshaft. In such a case, the camshaft is formed as a hollow shaft, while the other camshaft is made of solid material. The two camshafts are disposed mutually concentrically. The cams assigned to the associated camshafts are joined to the respective camshaft thereof to permit a circumferential rotation of the cams, and/or of the respective camshafts relative to one another, so that the valve timing of the intake and exhaust valves assigned to the cams is infinitely and variably adjustable.

The vanes of the rotors and those of the stator have a specific surface area, which, upon filling of the working chambers with a hydraulic medium, are subject to a pressure and thus to a circumferential force, resulting in the relative rotation. The response characteristic of such a hydraulic camshaft phaser is determined by this surface area and by the hydraulic medium pressure generated by a pressure medium pump.

SUMMARY OF THE INVENTION

It is an object of the present invention to provide a camshaft phaser that will be especially compact in design.

The present invention provides that the drive element and the output elements each feature two end faces that are disposed substantially orthogonally to the axis of rotation of the camshaft phaser. Between the end faces, the element is bounded by a lateral surface and forms a cylindrical hub. Extending out radially from this lateral surface are a plurality of vanes that are configured to form working chambers in such a way that, upon pressurization of the working chambers with a hydraulic medium, the circumferential distance between a vane pair changes, and a relative rotational movement between the drive element and the output elements is made possible. The configuration of the vanes on the lateral surface resembles a star or flower shape. The intermediate spaces between the vanes are axially bounded by plates that are connected in a rotationally fixed manner to the respective output element or the drive element directly or indirectly.

In accordance with the present invention, in response to pressurization of the working chambers, formed of the vanes of the two output elements, the volume of these working chambers, and/or the circumferential distance between the two vanes is increased. Thus, the angular position between the output elements is influenced by a hydraulic-medium channel and is achieved independently of the adjustment of the output elements relative to the drive element.

In response to filling of one of the working chambers with a hydraulic medium between the first output element and the drive element or between the second output element and the drive element, it is possible to vary the angle between the drive element and the corresponding output element. In response to simultaneous filling of the working chambers between the output elements and the drive element, the angular position between the output elements themselves is influenced at the same time. In response to filling of the working chambers between the output elements with a hydraulic medium, a relative rotation results between the output elements themselves directly without influencing the angular position of the output elements relative to the drive element.

The configuration in accordance with the present invention advantageously increases the adjustment angle of all of the elements because the circumferential space is better utilized for the partitioning of the working chambers by the vanes. It also proves to be simpler and more cost-effective when the hydraulic medium is supplied via one single hydraulic medium channel for the rotation of both output elements relative to one another and, in each case, via one hydraulic medium channel for the rotation of the respective output element relative to the drive element.

A constant angular position may be maintained between the output elements by hydraulically holding the hydraulic medium in the working chamber between the output elements, it now being possible for this angular position to be separately influenced by supplying pressure to one of the working chambers between the drive element and the respective output element. The advantage is hereby derived that a simpler design and construction of a control valve is made possible for controlling the supplying of a hydraulic medium into the working chambers, and/or for removing the same therefrom.

In one embodiment of the present invention, the vanes of the first output element project axially beyond a first output element surface that is offset in parallel from the end face, and overlap a lateral surface of the second output element, and/or the hub thereof due to a shape that is analogous to that of the first output element. In this context, the vanes of the second output element do not extend axially substantially beyond the end-face boundary edges thereof. Thus, the vanes of the drive element extend beyond the lateral surfaces of both output elements, the output elements being disposed coaxially one behind the other along the axis of rotation. Together with the vanes of the first output element, the vanes of the drive element form a vane pair, which, when pressurized by a hydraulic medium, rotates the first output element relative to the drive element. Together with the vanes of the drive element, the vanes of the second output element form another vane pair, which, when pressurized by hydraulic medium, rotates the second output element relative to the drive element. The independence of the vane pairs makes it possible for the working chambers to be advantageously independently driven and filled with a hydraulic medium, and for a mutually independent, rotational movement of each output element to be realized relative to the drive element. It is beneficial that the vanes are disposed in an overlapping, nesting configuration and that the axial space is reduced.

In another embodiment of the present invention, the vanes of the second output element likewise extend axially beyond the lateral surface of the first output element, as do the vanes of the first output element beyond the lateral surface of the second output element. In this case, the drive element axially overlaps the two output elements. The space in the axial direction is hereby effectively further reduced by the overlapping of the two output elements.

One embodiment of the present invention provides that the first output element have a contact surface between the end faces thereof that is offset in parallel thereto. The offset contact surface is in direct contact with a second, axially successive output element surface. Thus, the two output elements are disposed in an axially nested configuration. This contact surface is advantageously placed in the area of the hub of the output elements. The result is that the contact surface that is offset in parallel has another lateral surface that is formed to extend substantially completely circumferentially. Alternatively, the contact surface may be disposed outside of the end faces, whereby a pin-type projection is formed via which the two output elements are mutually centered and coaxially configured.

In one optional embodiment, the contact surface, which is contacted by both output elements, is provided with sealing means. Thus, it is not possible for any hydraulic medium to be conveyed via this contact surface.

The contact surface may be formed as an annular, plane surface. In a special case, annular may be also be understood to be circular. It is also alternatively possible that the contact surface is not planar, and/or not disposed orthogonally to the axis of rotation.

In one especially preferred embodiment, the output elements are each biased by a spring means, the drive element at least being disposed in one specific angular range. Here the advantage is derived that the respective output element is moved into a position of rest, and/or a locking position, toward the drive element in response to there being no prevailing hydraulic medium pressure. For the most part, torsion springs, and/or spiral springs come under consideration as spring means. Moreover, in addition to or independently of this preloading, the output elements may be biased relative to one another by a spring means. This spring means is capable of biasing both output elements counter to a pressurization of the working chambers between both output elements in such a way that the vanes of both output elements contact one another in the non-pressurized state, a base state between the output elements being thereby established. Alternatively, this spring element may also be configured to support the pressurization of the working chamber that is formed in accordance with the present invention.

One embodiment of the present invention provides for the camshaft phaser to have a locking mechanism that couples an output element to the drive element in the case of locking and thus to one another in a rotationally fixed manner, and, in the case of unlocking, decouples the same, thereby making possible a rotational movement of the respective output element relative to the drive element. Such locking mechanisms secure the position of the output element relative to the drive element in the non-pressurized state of the working chambers.

In one especially preferred embodiment, one of the output elements includes the locking mechanism. The locking mechanism may be located in one vane of the output element or in the hub of the output element. The drive element has a slotted piece with which a displaceable locking element is brought into engagement in order to block a relative rotational movement. The configuration of the locking mechanism in the area of the hub is advantageous since this embodiment makes it possible for the vanes of the output element to have a thin construction in the circumferential extent thereof, and thus for large angles of rotation to be realized in the case of a relative rotation.

Alternatively or additionally, a locking mechanism may couple the two output elements to one another in a rotationally fixed manner or, in the decoupled state of the locking mechanism, permit a relative rotation between the two output elements.

In another embodiment of the present invention, the vanes are equipped with sealing means that are resiliently formed in the radial direction. These sealing means seal the working chambers from one another and enhance the efficiency of the camshaft phaser by reducing internal leakage. In this context, it is advantageous that the spring-loading of the sealing means compensates for tolerances and play in the radial direction.

The sealing means, which may advantageously be spring-loaded, may be disposed alternatively or in combination with the configuration of the sealing means on the vanes, on the lateral surface of an output element, and/or of the output elements. The lateral surface bounds the hub of the output elements. Due to the configuration on the lateral surface, the vanes require less circumferential space.

The vanes themselves may function as sealing means provided that they are configured as insertion elements. The sealing vanes are advantageously spring-mounted as insertion elements in the radial direction.

In one advantageous embodiment of the configuration of the output elements and the drive element in accordance with the present invention, the output elements may be connected to the respective, assigned camshafts. The camshafts are concentrically disposed, the outer camshaft being formed as a hollow shaft, and the inner camshaft as a hollow shaft or of solid material. The drive element is operatively connected, for example, per traction drive, to the crankshaft. Each camshaft includes a group of cams for a specific function.

For example, one camshaft includes the cams for the exhaust valves, and the other camshaft, the cams for the intake valves. The cams for the inner camshaft are mounted on the outer hollow shaft, however, connected in a rotationally fixed manner to the inner camshaft by a pin connection. The pin connection projects through elongated holes of the outer hollow shaft. The mechanical connections of the output elements to the corresponding camshafts are realized non-positively, positively or as substance-to-substance bonds.

In one especially preferred embodiment of the present invention, in response to the rotational movement of the output elements relative to one another, the corresponding camshafts are also rotated relative to one another, whereby a valve-lift overlap may be realized, as are the output elements relative to the drive element, which results in the valve timing being changed relative to the crankshaft.

The advantageous configuration may be realized in very limited installation spaces. A camshaft phaser is provided that may be connected to a camshaft phaser system, whereby cam pairs may be rotated relative to one another to vary the valve-lift overlap, and, in addition, the camshafts relative to the drive element, which is operatively connected to the crankshaft, may be adjusted to adjust the valve timing relative to the piston position.

BRIEF DESCRIPTION OF THE DRAWINGS

Exemplary embodiments of the present invention are illustrated in the figures, which show.

DETAILED DESCRIPTION

Figure 1:
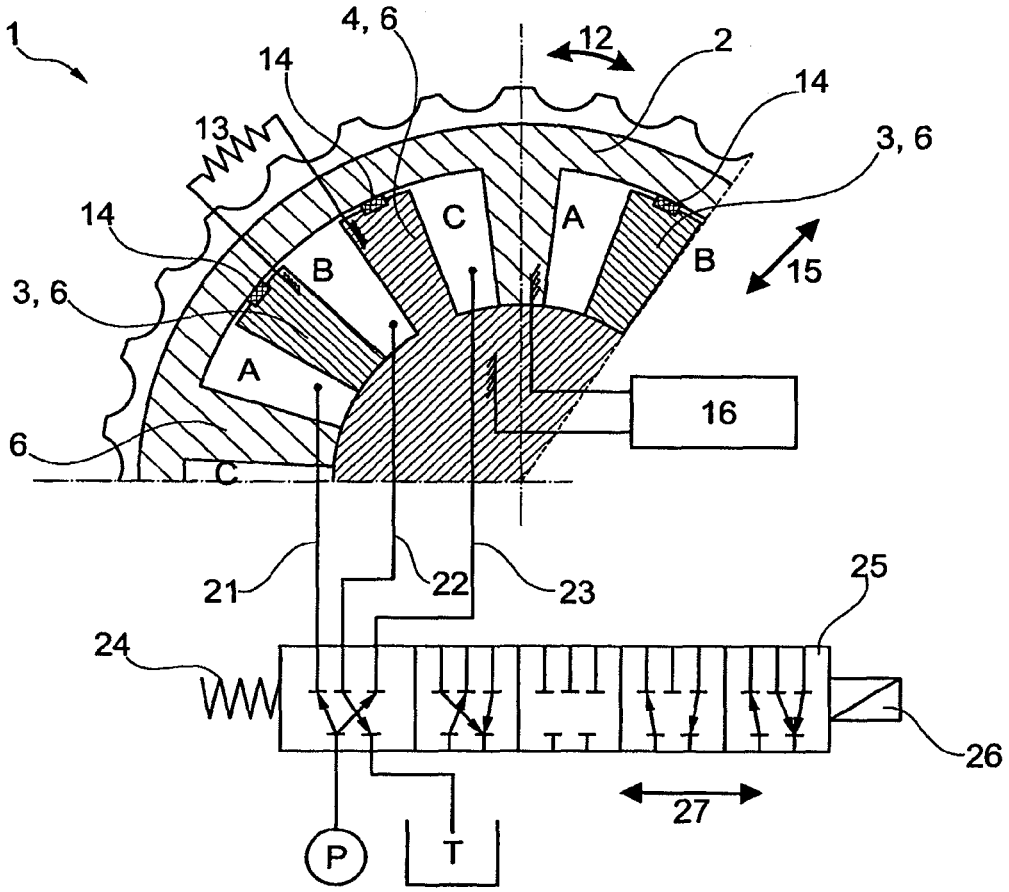
FIG. 1: a camshaft phaser according to the present invention in cross section along the axis of rotation of the camshaft phaser.

FIG. 1 shows a camshaft phaser 1 according to the present invention in cross section perpendicularly to axis of rotation 5 of camshaft phaser 1. This representation illustrates the manner in which working chambers A, B, C are formed by output elements 3 and 4 and drive element 2. Together with vanes 6 of drive element 2, vane 6 of output element 3 forms working chambers A. On the other hand, together with drive element 2, output element 4 forms working chamber C in a comparable manner. Working chamber B is formed between vanes 6 of first output element 3 and of second output element 4. The radial, outer ends of vanes 6 of output elements 3 and 4 have sealing means 14 which separate the working chambers from one another in an oil-tight manner. Sealing means 14 are preferably in the form of sealing strips that are spring-loaded in radial direction 15. Camshaft phaser 1 also has a spring element 13 in circumferential direction 12, at least between output elements 3 and 4. Alternatively possible is a configuration of spring element 13 between one of output elements 3 or 4 and drive element 2.

Thus, upon filling of working chamber A or C with a hydraulic medium, output element 3 may be rotated relative to output element 4, the volume of working chambers A and C increasing, and the volume of working chamber B decreasing. Upon simultaneous filling of working chambers A and C, the angle between output elements 3 and 4 is influenced. This is shown, for example, by the first position of control valve 25. The control valve has a plurality of positions for a targeted flow of a hydraulic medium into hydraulic-medium channels 21, 22, 23 to working chambers A, B and C that are selectable in sliding direction 27. Control valve 25 is actuated by a control-valve actuating mechanism 26 that may have an electromagnetic or hydraulic design. In response to filling of working chambers B with a hydraulic medium, a relative rotation results between output elements 3 and 4 themselves directly. Drive element 2 may be mechanically coupled to second output element 4 and decoupled therefrom by a locking mechanism 16 linked to second output element 4. Alternatively, this locking mechanism 16 may advantageously be configured between the two output elements 3 and 4, whereby, for example, until the decoupling, both output elements 3 and 4, and thus also camshafts 17 and 18 which are connectable in a rotationally fixed manner thereto, it being possible for camshaft 17 to be the intake camshaft, for example, and camshaft 18, the exhaust camshaft, may have a defined angle to one another and, as needed, be decoupled from a valve-lift overlap.

Figure 2:
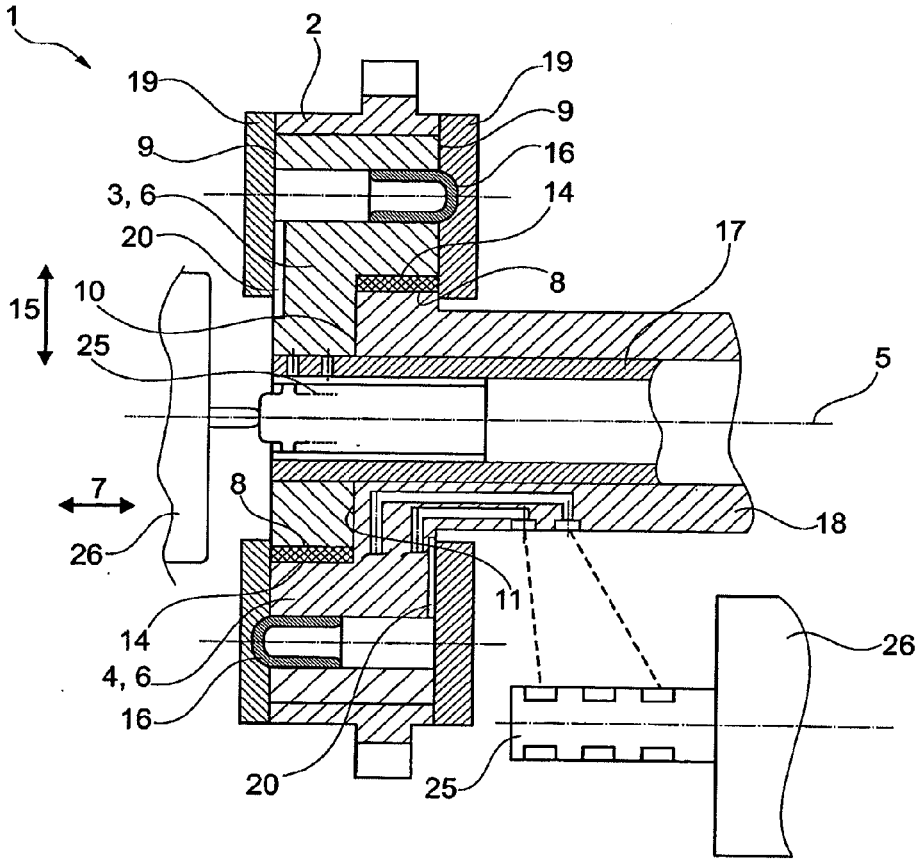
FIG. 2: a camshaft phaser according to the present invention in longitudinal section perpendicularly to the axis of rotation of the camshaft phaser.

FIG. 2 shows a camshaft phaser 1 according to the present invention in longitudinal section along axis of rotation 5 of camshaft phaser 1. Camshaft phaser 1 has a drive element 2, two output elements 3 and 4, two plates 19, a plurality of sealing elements 14, as well as in each case locking mechanisms 16 associated with the output elements. On the outer lateral surface, drive element 2 has a toothed ring for accommodating a traction means (not shown further). In addition, drive element 2 has a plurality of vanes 6 extending in radial direction 15. Output elements 3 and 4 are disposed concentrically to drive element 2. Output elements 3 and 4 likewise have a plurality of radially extending vanes 6. Vanes 6 of output elements 3 and 4 each form a plurality of working chambers A, B, C with drive element 2. At least one vane 6 of output element 3 has a locking mechanism 16. In axial direction 7, drive element 3 is limited in the outer dimensions thereof by end faces 9. Between these end faces 9, output element 3 has a contact surface 10 that is offset in parallel. Output element 3 is attached in a rotationally fixed manner by the hub thereof to an inner camshaft 17. Output element 4 likewise features a plurality of radially oriented vanes 6, at least one vane 6 having a locking mechanism 16. Locking mechanisms 14 are configured in parallel to axis of rotation 5 and designed to include a coupling piston and a spring element 13 (not shown). Sealing means 14 are disposed between drive element 3 and 4. These sealing means 14 are used for separating working chambers A, B, C (not shown here) to the greatest possible extent in an oil-tight manner from one another. Output element 4 likewise has a surface 11 that is offset in parallel and that is disposed between end faces 9 thereof, which is in direct contact with contact surface 10 of output element 3. Output element 4 is connected in a rotationally fixed manner to outer camshaft 18. Camshaft phaser 1 is axially flanked by two plates 19. These plates 15 have guide slots into which the coupling pistons of locking mechanisms 16 may engage, in order to thereby provide a rotationally fixed connection between the respective output element 3 or 4 and drive element 2.

FIG. 2 illustrates the locked position of the coupling piston of locking mechanism 16. At the end face facing away from the camshaft, output elements 3 and 4 have ventilation channels 20 which release impurities from locking mechanisms 16, especially from the spring chamber in which a locking spring is located, to the ambient environment, and/or evacuate them from camshaft phaser 1. These ventilation channels 20 are formed by the axial, flat configuration of respective output element 3 or 4 and by plate 19 facing away from the camshaft, and extend in radial direction 15.

Vanes 6 of output element 3 extend in axial direction 7 over a lateral surface 8 of output element 4. Vanes 6 of output element 4 likewise extend over a lateral surface 8 of output element 3. In this overlap region, sealing means 14 are disposed in the radial gap between vanes 6 and lateral surface 8.

In addition, the configuration has two control valves 25, one being designed as a central valve and the other as a cartridge valve. Control valves 25 are operated by a control-valve actuating mechanism 26 that may be designed as an electromagnet.

LIST OF REFERENCE NUMERALS

1) camshaft phaser
2) drive element
3) first output element
4) second output element
5) axis of rotation
6) vane
7) axial direction
8) lateral surface
9) end face
10) contact surface
11) surface
12) circumferential direction
13) spring element
14) seals
15) radial direction
16) locking mechanism
17) first camshaft
18) second camshaft

19) plate
20) ventilation
21) hydraulic-medium channel A
22) hydraulic-medium channel B
23) hydraulic-medium channel C
24) compression spring
25) control valve
26) control-valve actuating mechanism
27) sliding direction
A) working chamber
B) working chamber
C) working chamber
P) hydraulic medium supply
T) tank

What is claimed is:

1. A camshaft phaser comprising:

a drive element;

a first output element; and a second output element, each of the first and second output elements being disposed coaxially to an axis of rotation of the camshaft phaser, the first and the second output elements being disposed in axial succession, the first and second output elements and the drive element having a plurality of radially oriented vanes defining a plurality of working chambers suppliable with a hydraulic pressure medium to permit a relative rotation between the drive element and the first and second output elements, a first working chamber of the plurality of working chambers being formed by a vane of the first output element and by a further vane of the second output element, whereby, in response to pressurization of the working chambers with a hydraulic medium, at least one of a volume of the first working chamber of the plurality of working chambers and a circumferential distance between the vane and further vane is increased;

wherein the vane of the first output element extends in the axial direction along a lateral surface of the second output element;

wherein the further vane of the second output element extends in the axial direction along a lateral surface of the first output element.

2. A camshaft phaser comprising:

a drive element;

a first output element;

a second output element, each of the first and second output elements being disposed coaxially to an axis of rotation of the camshaft phaser, the first and the second output elements being disposed in axial succession, the first and second output elements and the drive element having a plurality of radially oriented vanes defining a plurality of working chambers suppliable with a hydraulic pressure medium permitting a relative rotation between the drive element and the first and second output elements, a first working chamber of the plurality of working chambers being formed by a vane of the first output element and by a further vane of the second output element, whereby, in response to pressurization of the working chambers with a hydraulic medium, at least one of a volume of the first working chamber of the plurality of working chambers and a circumferential distance between the vane and further vane is increased; and a locking mechanism preventing or permitting a rotation of the drive element relative the first output element;

wherein the vane of the first output element has the first locking mechanism.

3. A camshaft phaser comprising:

a drive element;

a first output element;

a second output element, each of the first and second output elements being disposed coaxially to an axis of rotation of the camshaft phaser, the first and the second output elements being disposed in axial succession, the first and second output elements and the drive element having a plurality of radially oriented vanes defining a plurality of working chambers suppliable with a hydraulic pressure medium permitting a relative rotation between the drive element and the first and second output elements, a first working chamber of the plurality of working chambers being formed by a vane of the first output element and by a further vane of the second output element, whereby, in response to pressurization of the working chambers with a hydraulic medium, at least one of a volume of the first working chamber of the plurality of working chambers and a circumferential distance between the vane and further vane is increased; and a seal disposed between the first and second output elements;

wherein the first and second output elements overlap radially and the seal is disposed radially between the first and second output elements.

* * * * *